US006250949B1

(12) United States Patent
Lin

(10) Patent No.: US 6,250,949 B1
(45) Date of Patent: Jun. 26, 2001

(54) COMMUNICATION CABLE TERMINATING PLUG

(75) Inventor: Chen-Chieh Lin, Indianapolis, IN (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/212,889

(22) Filed: Dec. 16, 1998

(51) Int. Cl.[7] ..... H01R 4/24
(52) U.S. Cl. ..... 439/418; 439/344
(58) Field of Search ..... 439/460, 462, 439/676, 404, 941, 344, 395, 418

(56) References Cited

U.S. PATENT DOCUMENTS 5,830,005 * 11/1998 Watanabe ..... 439/418
5,899,770 * 5/1999 Ezawa ..... 439/418
5,911,594 * 6/1999 Baker, III et al. ..... 439/404
6,045,389 * 4/2000 Ferrill et al. ..... 439/398
6,056,586 * 5/2000 Lin ..... 439/460

* cited by examiner

*Primary Examiner*—Neil Abrams
*Assistant Examiner*—Michael C. Zarroli

(57) ABSTRACT

A modular communication plug for terminating communication cables has a housing having a connector end including a conductor alignment region having a plurality of parallel slots therein and a conductor organizing sled insertable into the housing. The sled is an elongated member having a connector end which fits within the conductor alignment region of the housing, and a cable termination end. A plurality of septa form channels or passages for twisted pairs of wires and lead to an array of parallel grooves at the connector end. The septa are insertable within the jacket of the cable, which is crimped thereto by means of a crimping ring. A split wedge collar surrounds the crimping ring and is, when in position, latched to the housing to hold the sled therewithin. A plurality of contact blades are insertable into the slots in the housing to make electrical contact with the wires in the grooves. The sled is provided with a cap or cover member for preventing the conductors in the sled from bellying up.

19 Claims, 8 Drawing Sheets

COMMUNICATION CABLE TERMINATING PLUG

FIELD OF THE INVENTION

The present invention relates generally to the field of cable connectors and more specifically to a modular plug for terminating round cables or cordage carrying conductor pairs.

BACKGROUND OF THE INVENTION

In the telecommunications industry, modular plug type connectors are commonly used to connect customer premise equipment (CPE), such as telephones or computers, to a jack in another piece of CPE, such as a modem, or in a wall terminal block. These modular plugs terminate essentially two types of cable or cordage: ribbon type cables and round cables.

In ribbon type cables, the conductors running therethrough are arranged substantially in a plane and run, substantially parallel, alongside each other throughout the length of the cable. The individual conductors may have their own insulation or may be isolated from one another by channels defined in the jacket of the ribbon cable itself, with the ribbon jacket providing the necessary insulation. Conversely, the conductors packaged in a standard round cable may take on a random or intended arrangement with conductors being twisted or wrapped around one another and changing relative positions throughout the cable length.

Traditional modular plugs are well suited for terminating ribbon type cables. Typically, these plugs are of a dielectric, such as plastic, structure in which a set of terminals are mounted side by side in a set of troughs or channels in the plug body such that the terminals match the configuration of the conductors in the cable connected thereto. When the plug is inserted into a jack, the terminals electrically engage jack springs inside the jack to complete the connection.

On the other hand, termination of standard round cables or cords poses unique assembly problems for the skilled technician. For example, termination of a round cable carrying, for example, four conductor pairs by means of an existing modular plug requires the following steps: First, the cable or cord jacket must be stripped to access the enclosed conductors. Next, because the conductors in a conductor pair are generally twisted around one another, the twist must be removed and the conductors oriented to align with the required interface. For some standardized plugs, aligning the conductors also involves separating the conductors in at least one of the pairs and routing these over or under conductors from other pairs while orienting all the conductors in a side-by-side plane, thus, the orientation process can result in various conductors of different pairs crossing over each other, thereby inducing crosstalk among the several conductor pairs.

Crosstalk is defined as the cross coupling of electromagnetic energy between adjacent conductor pairs in the same cable bundle or binder. Crosstalk can be categorized in one of two forms: Near End Crosstalk, commonly referred to as NEXT, is the most significant because the high energy signal from an adjacent conductor can induce relatively significant crosstalk into an attenuated receiver signal. The other form is Far End Crosstalk or FEXT. FEXT is typically less of an issue because the far end interfering signal is attenuated as it traverses the loop. Because the jack springs, conductors and the plug terminals or contacts near the jack springs are generally quite close to, and exposed to, one another in a communication plug, control of crosstalk is a paramount consideration in any plug design. Unfortunately, crosstalk in a communication plug cannot be merely eliminated. Jacks are engineered to generate a certain amount of compensating crosstalk to counter the crosstalk produced in the plug. Accordingly, a communication plug should be designed to optimize rather than to minimize crosstalk.

In modular plugs currently in use, when the conductors are untwisted and inserted into the front of the plug housing, it is difficult to control their lengths, which, in turn, causes variation in electrical performance. This lack of precise control also leads in variations in electrical performance from plug to plug, whereas reproducibility of performance is a desideratum. In addition, an anchor bar is generally used to hold the cord or cable in the housing, thereby provide strain relief. However, the anchor bar deforms the cable and introduces a random variable in performance which is caused by the conductors being forced together at different stages of their twist. As a consequence, it is difficult to predict a plug's electrical characteristics, and the high degree of variability can result in reduced signal carrying performance in at least some of the circuits. This problem is discussed fully in U.S. Pat. No. 6,056,586 of Lin, issued May 2, 2000, the disclosure of which is herein incorporated by reference.

Also, in some current high frequency communication plugs, the conductors are terminated in the middle of the plug by insulation displacement connectors. The materials cost of the plug is greatly increased due to the amount of material such as phosphor bronze required by this type of structure. Also, in such a plug, the overall dimensions of the plug are increased, which hinders or prevents use of the plug in a confined place, such as high-density network hubs.

In addition, the technician time involved in the prior art practice of separating out the twisted pairs of conductors and routing them to their proper terminals in the plug is considerable. Even if the technician, splicer, or other assembly person is accurate in the disposition of the conductors, the time consumed by him or her in achieving such accuracy is considerable. Thus, the time spent in properly routing the conductors can add considerable cost. When it is realized that thousands of such connections are made daily, involving at least hundreds of technicians, it can be appreciated that any reduction in time spent in assembling the plug can be of considerable economic importance.

Accordingly, there exists a need for a modular plug that can terminate a standard round cable and that provides a straightforward interface between the conductors in the cable and the plug terminals, involving less assembly time than heretofore, and which has substantially unvarying electrical characteristics from plug to plug.

SUMMARY OF THE INVENTION

The present application is a modular communication plug for terminating a cable having a plurality of conductors therein, wherein the plug has a unique "sled" for organizing and orienting the conductors of the cable prior to insertion of the sled into a housing having a conductor alignment region at one end.

The housing comprises a substantially hollow member forming a chamber for the sled, and having an opposite closed end having a conductor alignment region including a plurality of electrical contact members for establishing electrical contact with the jack spring contacts of a standard jack.

The sled for insertion into the housing comprises a first, or cable, end having a plurality of septa formed in a cruciform shape for insertion into the cable. The cruciform shape creates four separate conductor passages for the twisted pairs within the cable, and the cable jacket fits over the septa or partition walls. While the principles of the invention are herein illustrated as a structure for a cable having four twisted pairs, an industry standard, it is readily apparent that a cable having a different member of twisted pairs can be equally as expeditiously terminated, in which case, the septa would be oriented to create additional passages. Each twisted pair is assigned to one of the passages, and extends therethrough to a neck-down region in each passage. The neck-down region holds the conductors in a vertical position, i.e., one wire on top of the other, and prevents untwisting of each of the pairs. Beyond the neck-down region, is a straight tray region terminating in a planar array of grooves for holding each of the conductors in position for insertion into the housing and into the conductor alignment region thereof, and the ends of the conductors are trimmed to be flush with the end of the sled. Conductor contact tangs, one for each conductor, are insertable in slots in the housing into electrical contact with the wires, and also serve as the contacting members with which the spring contacts of the jack make contact.

The sled component defines the length of the region in which the conduction are untwisted and arranged parallel to each other. Accordingly, the amount of crosstalk developed in the plug can be fixed by altering the length of the sled without altering the overall dimension of the plug. Thus, the plug, according to the present invention, can be made to work with so-called legacy jacks that require a certain amount of complementary crosstalk to be generated in the plug.

A cap member fits over the sled in the channel region and effectively straddles the sled in that region. Depending legs of the cap having latching means on their distal ends which serve to latch the cap to the sled prior to insertion into the housing. The cap member serves to provide a cover for each of the channels so that, when the wires are in place within the channels, they are prevented from bellying up and out of their respective channels. The cap also has an extension thereon that cover a portion of the otherwise exposed wires and functions also to reinforce the thin walls on the sled when in place.

A metallic ring or band is crimped around the cable jacket to affix the jacket to the septa without distorting the twisted pairs, and a split wedge collar surrounding the ring is compressed by the housing when the sled and cable are in place therein. The wedge collar has locking tabs thereon which mate with slots in the housing to hold the sled firmly in place within the housing.

The numerous features of the present invention will be made more clear in the following detailed description, read in conjunction with the accompanying drawings.

DETAILED DESCRIPTION

In the following description, the terminating plug of the invention will be described as used with a cable commonly used in the art having four twisted pairs of insulated wires in a protective sheath typically of polyvinyl chloride (PVC) or other suitable material. Typically, the wires are identified by the color of their insulation, and the two wires of each pair are twisted about each other, and the pairs, in turn, are twisted about each other. It is well known in the art that such twisting of the wires and of the pairs serves to achieve a substantial reduction in crosstalk between individual wires and wire pairs within the cable. It is to be understood, however, that cables containing other numbers of wires and wire pairs can be terminated by plugs embodying the features and principles of the present invention. Also, such term as "bottom", "top", "front", "rear", and the like refer to orientations in the several figures, and not to any orientation that may occur in actual usage or practice.

Figures 1, 1B:
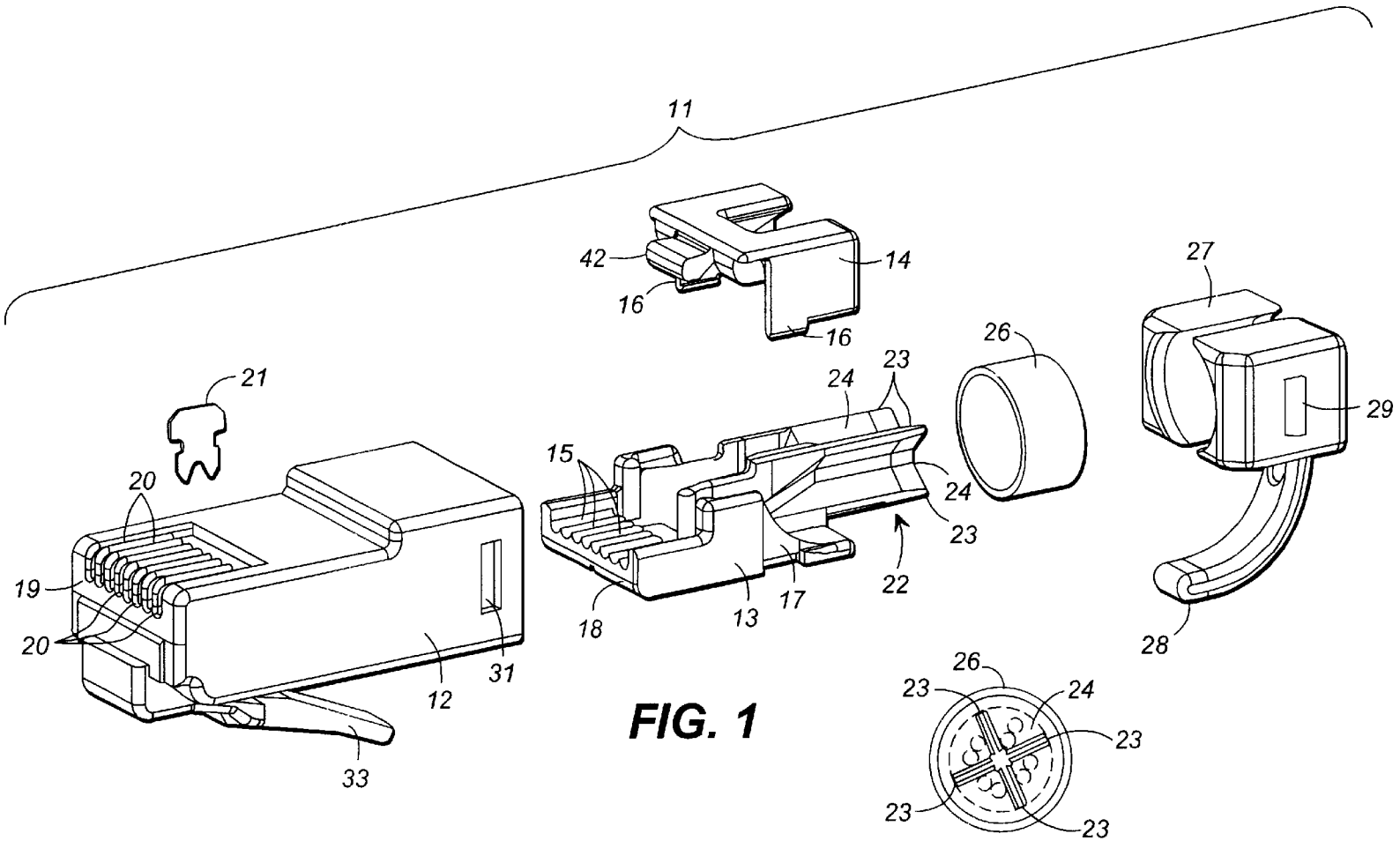
FIG. 1 is an exploded perspective view of the cable termination plug embodying the principles of the invention.
FIG. 1*b* is a cross-sectional view of the cruciform of the sled as inserted within the cable.

FIG. 1 is an exploded perspective view of the cable terminating plug 11 of the present invention, illustrating the several component parts thereof. Plug 11 comprises an outer housing member 12 having a hollow interior for housing a wire organizing sled 13. Preferably housing 12 and sled 13 are made of suitable dielectric (e.g., plastic) material. A cap or cover member 14, preferably of the same or similar material, has depending latch arms 16, the distal ends of which are configured to latch to the bottoms of slots 17 in sled 13. Sled 13, as can be seen, is an elongated member having a longitudinal axis and also having a flat floor portion and first and second side walls. The connector end 18 of sled 13 has a plurality of parallel grooves 15 therein which, as will be discussed more fully hereinafter, are adapted to hold the several wires from the cable (not shown) in parallel relationship in a planar array. Housing 12 has, at its connector end 19, a conductor alignment region having a plurality (e.g., eight) slots 20 into which blade contact member 21 are insertable. Contact member 21 have sharp points for piercing the insulation of the wires lying in grooves 15 for making electrical contact therewith. Blades 21, in turn, are positioned in the slots 20 for making electrical contact with jack springs in the jack (not shown) for receiving the plug 11.

Sled 13 at its cable termination end 22 has four septa 23 arranged in a cruciform configuration to create four wire pair channels or passages 24, only two of which are shown, which are parallel to the longitudinal axis. The distance between the distal edges of oppositely disposed septa is slightly less than the inner diameter of the protective sheath of the cable, so that the cable end 22 of the sled may be inserted into the cable sheath. A crimping ring or ferrule 26 of suitable metallic material having an inside diameter sufficient to allow it to be slipped over the cable end with the sled inserted therein. When the ring 26 is crimped, the cable sheath is held tightly against the distal edges of the septa 23, thereby insuring strain relief by its resistance to longitudinal or axial forces as shown in FIG. 1*b*. Because of this unique strain relief arrangement the wires and wire pairs of the cable, being situated in the channels 24, are not subject to lateral forces that tend to distort their orientation with respect to each other, as is common in prior art devices. Such distortion can produce changes or increases in crosstalk between the wires which is unpredictable and, therefore, to be avoided.

A split wedge collar 27, having a curved anti-snag arm 28 depending therefrom is adapted to fit over the crimped end of the cable for insertion into housing 12, where it is latched in place by means of latch members 29 on either side thereof which fit into latching slots 31 in housing 12. When collar 27 is latched in place, the sled is locked in place within housing 12 and the plug is then, in essence, a single unitary structure.

Figure 2A:
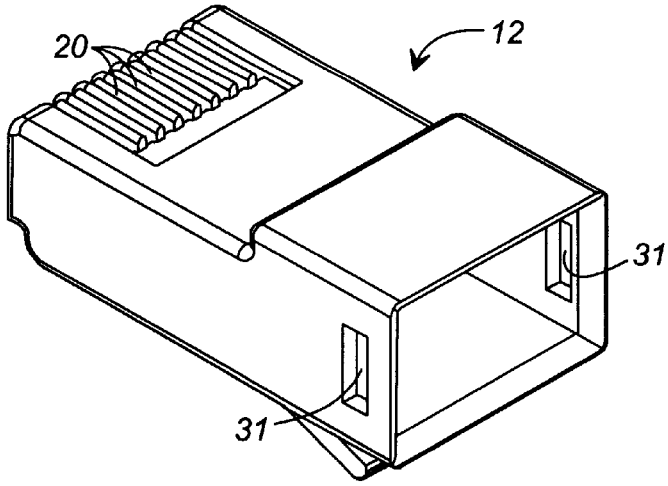
FIG. 2*a* is a perspective view of the housing of the plug of FIG. 1.
Figure 2B:
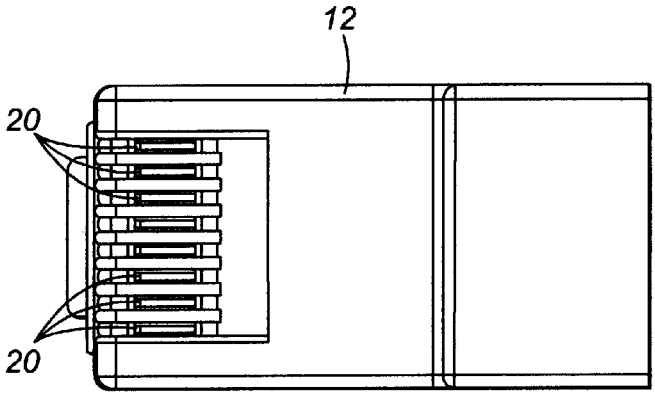
FIG. 2*b* is a top plan view of the housing.
Figure 2C:
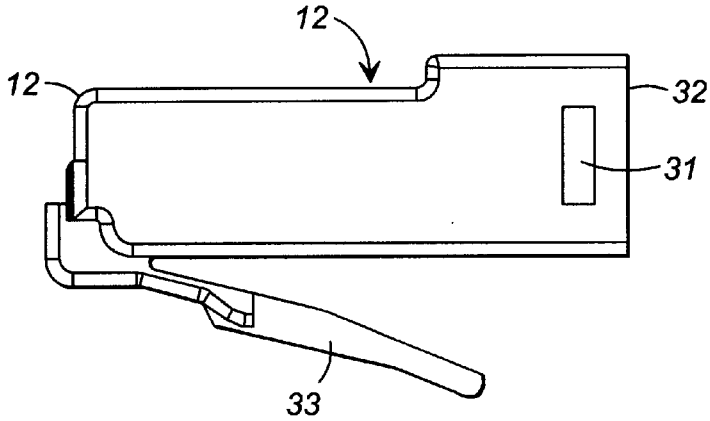
FIG. 2*c* is a side elevation view of the housing.
Figure 2D:
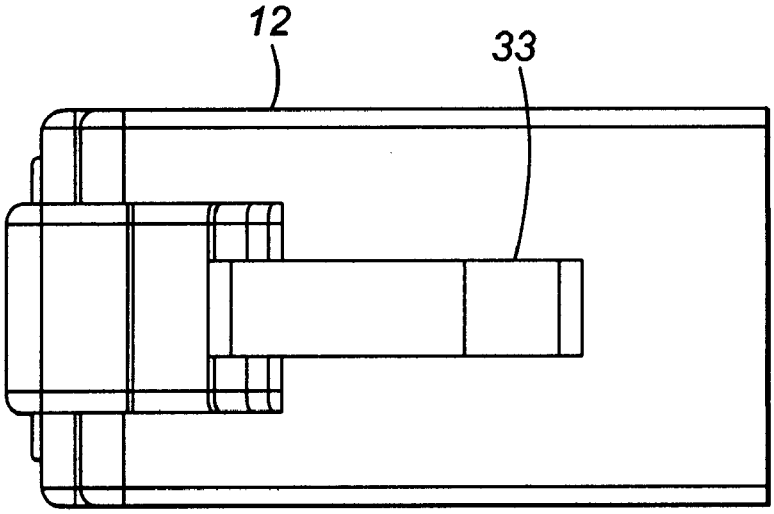
FIG. 2*d* is a bottom plan view of the housing.
Figure 2E:
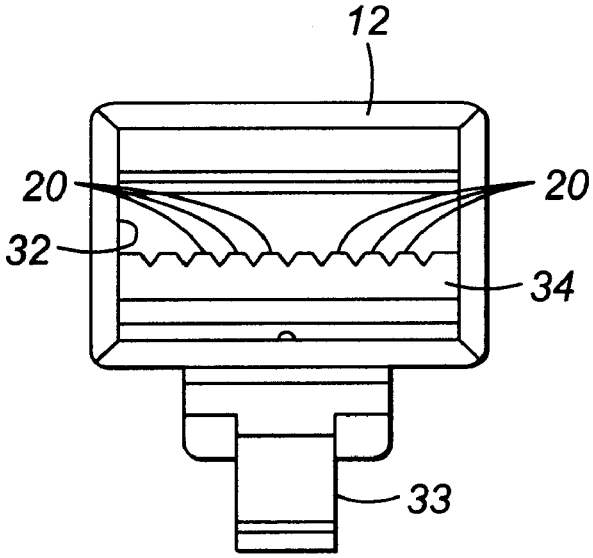
FIG. 2*e* is an end view of the rear of the housing.

FIGS. 2*a* through 2*e* are several views of the housing 12. Housing 12 has an opening 32 to its hollow interior, the opening 32 and the interior being sized to receive the sled 13 when inserted therein. A latching arm 33 depends from housing 32 in an angular orientation, as best seen in FIG. 2*c*, and is functional in locking and unlocking plug 11 from the jack or other receptacle into which it is inserted during use. In FIG. 2*e* can be seen the array of the bottom ends of slots 20, under which the connector end 18 of the sled 13 slides into a space 34.

Figure 3A:
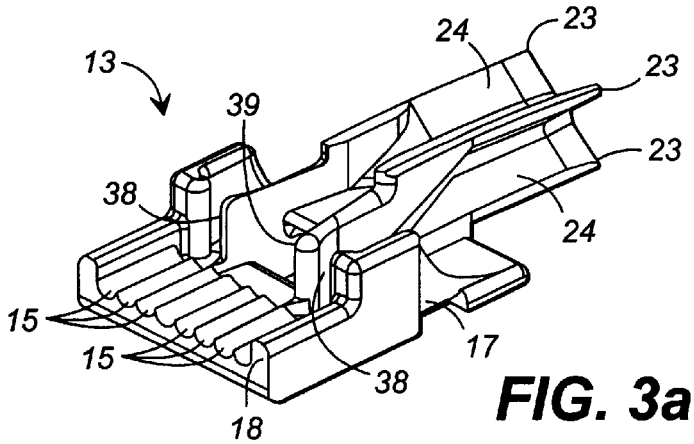
FIG. 3*a* is a perspective view of the sled of the invention.
Figure 3B:
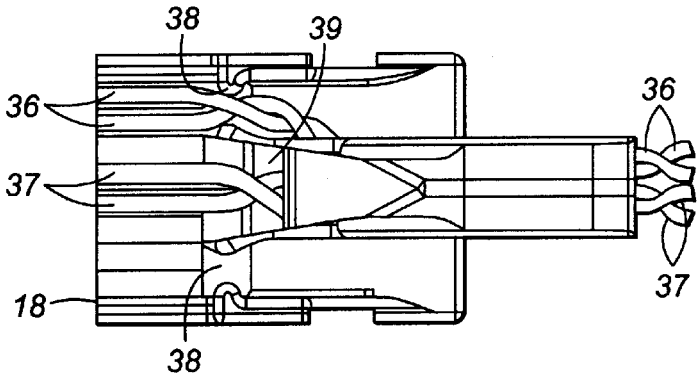
FIG. 3*b* is a top plan view of the sled.
Figure 3E:
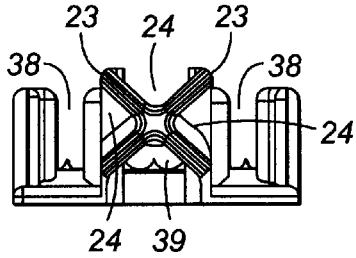
FIG. 3*e* is an end view of the rear end of the sled.
Figure 3C:
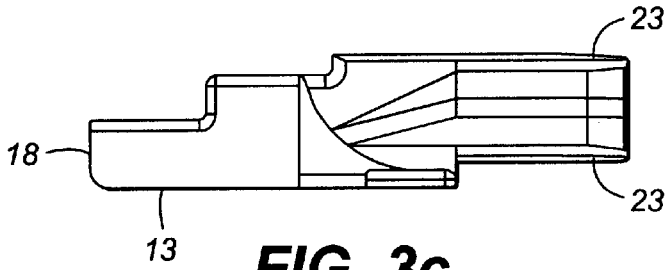
FIG. 3*c* is a side elevation view of the sled.
Figure 3D:
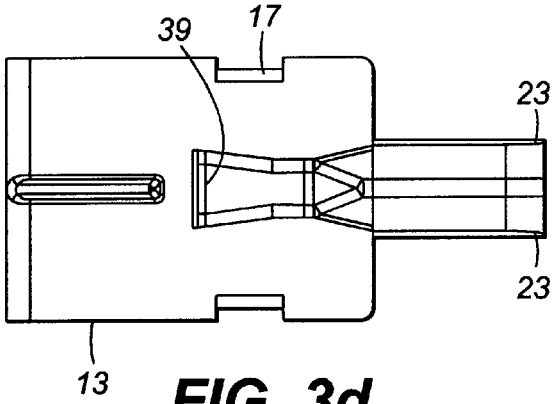
FIG. 3*d* is a bottom plan view of the sled.

FIGS. 3*a* through 3*e* are several views of the sled 13 of the present invention. In FIG. 3*b*, which is a top plan view of the sled 13, two twisted pairs of wires 36 and 37 are shown to illustrate the manner in which they are organized by sled 13. It is to be understood that the location of the pairs 36 and 37 in the grooves 15 is for illustrative purposes, and is not intended necessarily to be the particular grooves shown. In U.S. patent application Ser. No. 09/052,528; filed Mar. 31, 1998 (Beecher et al. 8–1214), the disclosure of which is incorporated herein by reference, there is a discussion of the orientation of the wires of the several pairs for a plug designed, as is the present cable terminating plug, for use with a standard jack.

In FIG. 3*b*, the twisted pair 36 passes from the cable, not shown, through a side channel 24 (FIG. 3*a*), in which the twist is maintained, to a neck-down portion 38 at the end of the channel which forces the wires of pair 36 into a vertical alignment, i e., one wire on top of the other. From the neck-down portion 38 the two wires are straight and parallel, lying in grooves 15, as can be seen. Thus, the twist in the pair is maintained up to the point where they are laid flat and parallel, thereby reducing the potential for crosstallk that would obtain if they were straightened at a point in the sled before the neck-down portion 38. Both of the side channels 24 formed by the septa 23 have a neck-down portion 38. The top channel 24 does not have a neck-down portion, nor does the bottom channel 24 which is on the underside of the sled 13, and communicates with the grooves 15 through the opening 39. As pointed out hereinbefore, the two wires of pair 37 are shown lying in adjacent grooves 15. More often than not, depending upon which particular leads they represent, they will lie in separated grooves. However, the configuration of the sled makes it possible to organize the wires as is necessary for connection to the jack, while minimizing or, at least, controlling crosstalk, by minimizing the length of the non-twisted portions of the wire lengths. Some variations in crosstalk can be realized by changing the length of one or more of the parallel wires in the grooves 15, or by changing the length of the grooves themselves.

On either side of sled 13 are notches or slots 17 which receive the latching arms 16 of cap member 14 which latch to the bottoms of slots 17 to hold cap member 14 in place.

Figure 4A:
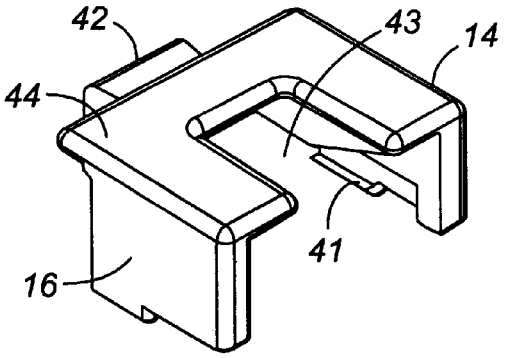
FIG. 4*a* is a perspective of the cap or cover for the sled of the invention.
Figure 4B:
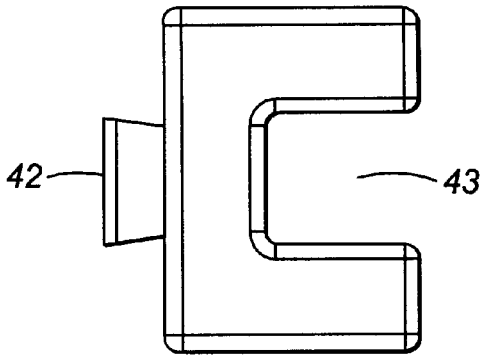
FIG. 4*b* is a top plan view of the cap.
Figure 4C:
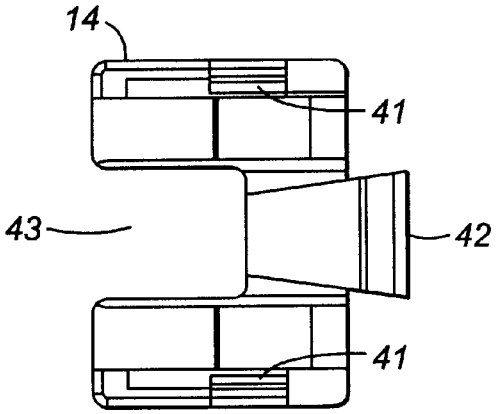
FIG. 4*c* is a bottom plan view of the cap.
Figure 4D:
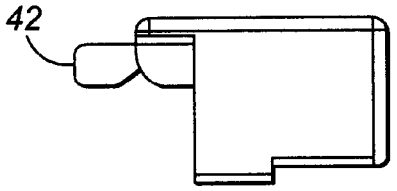
FIG. 4*d* is a side elevation view of the cap.
Figure 4E:
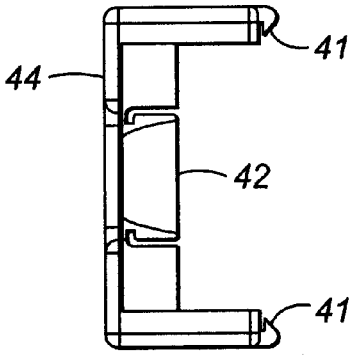
FIG. 4*e* is a rear end view of the cap.
Figure 5A:
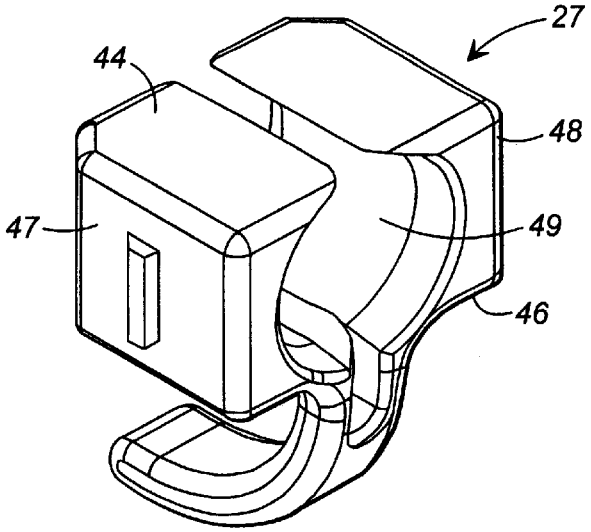
FIG. 5*a* is a perspective view of the split wedge collar of the invention.
Figure 5B:
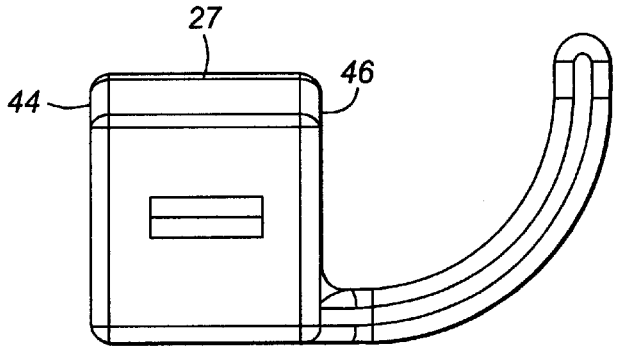
FIG. 5*b* is a side view of the collar.
Figure 5C:
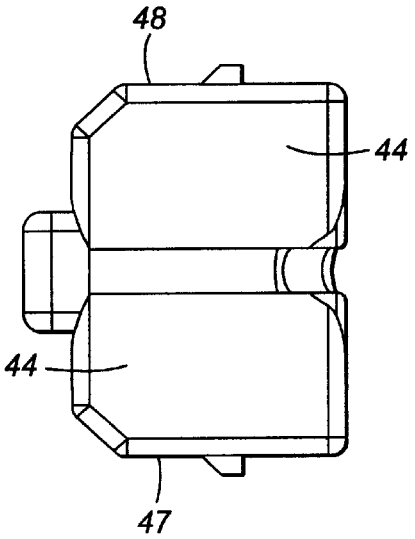
FIG. 5*c* is a bottom plan view of the collar.
Figure 5D:
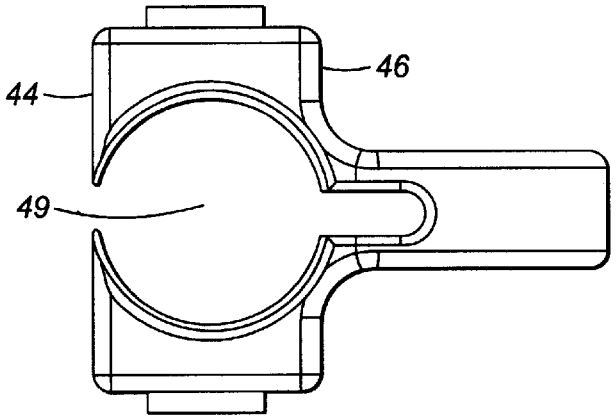
FIG. 5*d* is a front view of the collar.
Figure 6A:
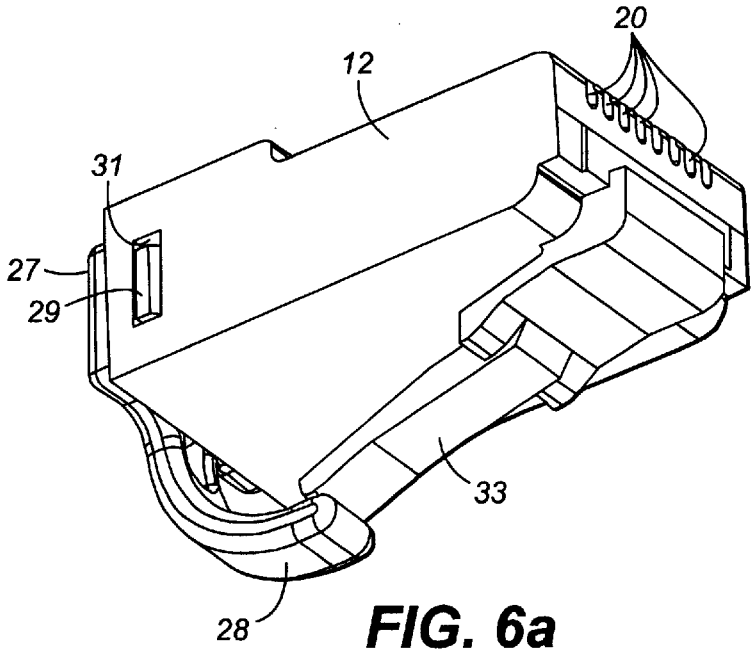
FIG. 6*a* is a perspective view of the assembled cable termination plug of the invention.
Figure 6B:
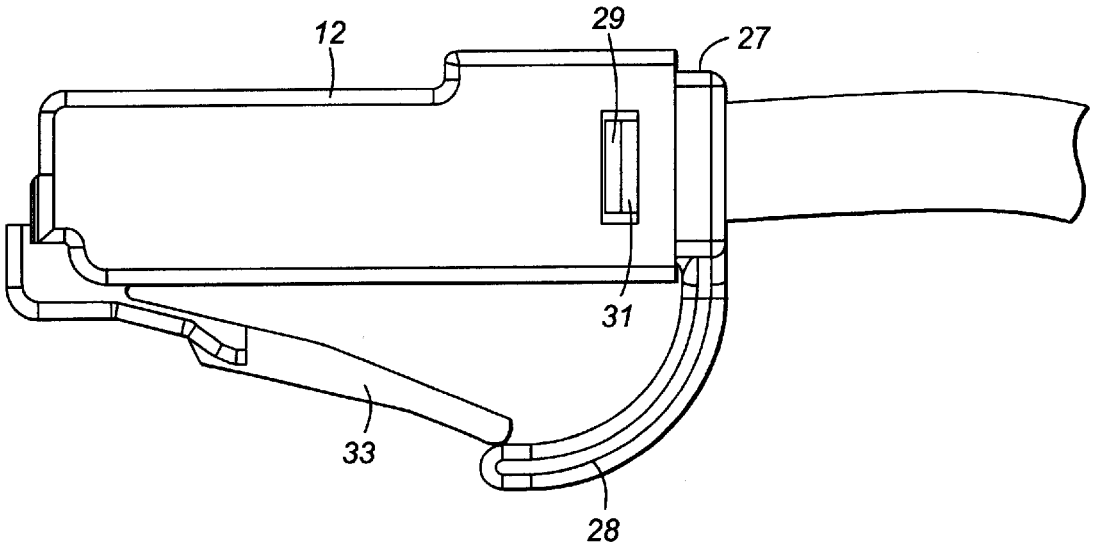
FIG. 6*b* is a side elevation view of the assembled plug.
Figure 6C:
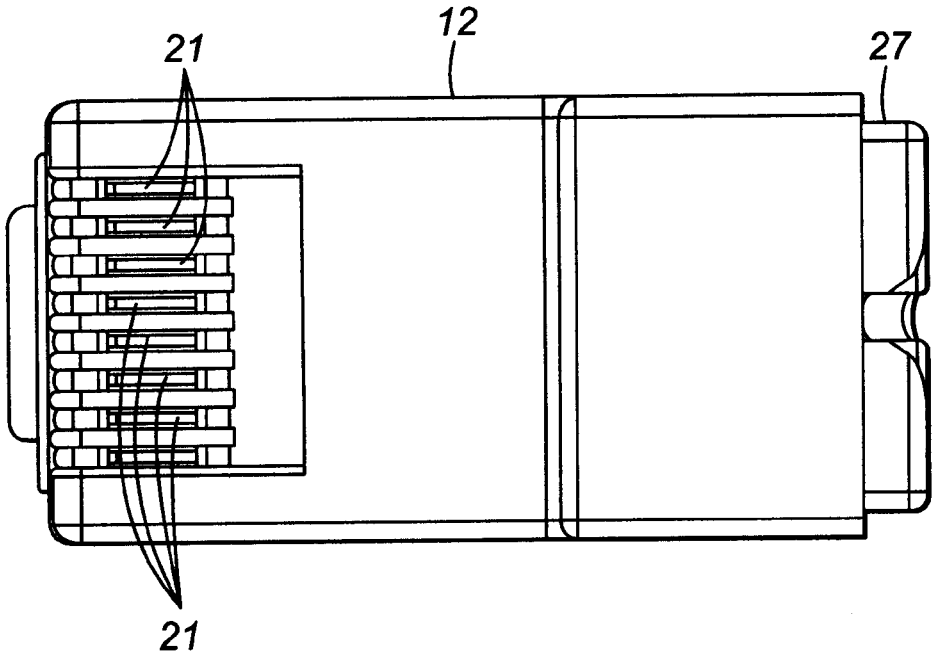
FIG. 6*c* is a top plan view of the plug.
Figure 6D:
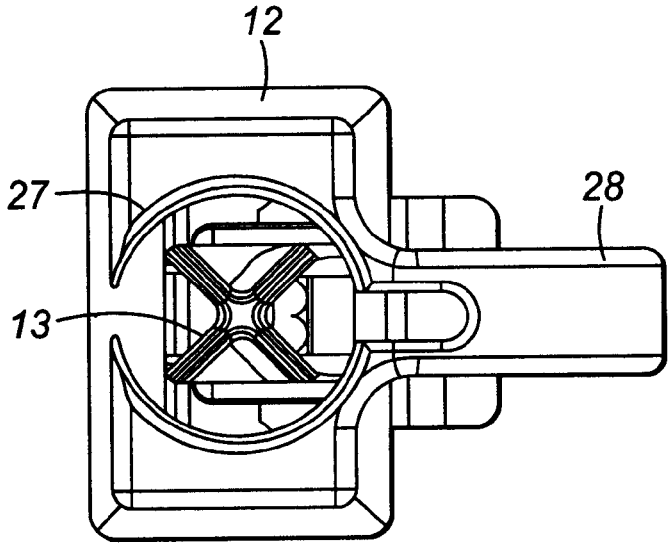
FIG. 6*d* is a rear end view of the plug.

Cap member 14 is shown in FIGS. 4*a* through 4*e* and, as shown in FIG. 4*a*, has depending sides or arms 16 which are designed to fit within the notches or slots 17 on sled 13. The bottom or distal end of each of arms 16 has a latching lip 41 which, when the cap 14 is placed on sled 13, latches to the bottom edge of slot 17. Cap 14 has an extension 42 which projects forwardly between the walls of sled 13 which are extensions of the top channel 24, and adds a measure of structural support thereto. Extension 42 also overlies the pair of wires which are directed from the bottom channel 24 of sled 13 through opening 39 to the grooves 15 and serves to prevent them from bulging upward. Cap 14 also has an open or recessed portion 43 in the top surface 44 thereof which provides visual access to the wire pair in the upper channel or passage 24 on sled 13.

FIGS. 5*a* through 5*d* are several views of the split wedge collar 27, which comprises a body of suitable plastic material having split top and bottom surfaces 44 and 46 joined by depending side walls 47 and 48. An opening 49 is formed in the body of collar 27 which is sized to fit over the cable and the crimping ring 26. Each of the side walls 47 and 48 has a latching projection 29 thereon designed and positioned to fit within latching slots 31 to hold collar 27 in place when it is pressed into housing 12. The splits in collar 27 permit it to be compressed when being inserted into housing 12, but even when the latching projections are seated in the slots 31, the collar 27 tightly grips the end of the cable, thereby anchoring it to sled 13 and to housing 12.

Depending from the lower or bottom of collar 27 is a curved anti-snag arm 28 which, as will be apparent hereinafter, functions to prevent latching arm 33 from snagging or being snagged and which also functions as an actuator for latching arm 33. Thus, pressure on arm 28 will be transmitted to latching arm 33 for inserting the plug 4 into a jack, or for removing it from the jack. Because of the small sizes of the plug and jack, it can be difficult for an installer to actuate arm 33. This difficulty is materially reduced by the action of anti-snag arm 28.

The assembled plug 11 of the invention is shown in FIGS. 6*a* through 6*d*. As can be seen, a cable 30, having the cruciform configured septa arrangement of sled 13 inserted therein, the crimping ring 26 crimped around the cable jacket, and the wedge collar 27 surrounding the crimped portion, is inserted into the rear of housing 12 until latch members 29 snap into latching slots 31. Anti-snag arm 28 rides over the distal end of latching arm 33 when wedge collar 27 is in place and, in this position, prevents inadvertent snagging of latching arm 33. It can be appreciated that, in addition, pressure on arm 28 will be transmitted to arm 33 to latch or unlatch the plug 11 relative to the jack.

The plug of the invention, a preferred embodiment of which has been described in the foregoing, reduces the amount of crosstalk among the pair of conductors by maintaining the conductors in twisted relationship up to the point in the plug where they are arrayed in the parallel grooves. Such an organization of the conductors is quickly and easily accomplished by an installer, for example, and insures a degree of stability in the electrical characteristics from plug to plug. In addition, as pointed out hereinbefore, some variation in crosstalk can be achieved, if necessary or desired by slight variations in the lengths of the straight portions of the conductors.

In conclusion, it should be noted that it will be obvious to those skilled in the art that many variations and modifications may be made to the preferred embodiment without substantial departure from the principles of the present invention. It is intended that all such variations and modifications are to be included herein as within the scope of the present invention, as set forth in the claims. Further, in the claims hereafter, the corresponding structures, materials, acts, and equivalents of all means or step plus function elements are intended to include any structure, material, or acts for performing the functions with other claimed elements as specifically claimed.

I claim:

1. A plug for terminating a jacketed communication cable having a plurality of twisted pairs of conductors held therein, said plug comprising:

a housing having a first end having an opening therein for receiving an elongated conductor organizing sled and a second end having a plurality of slots for receiving contact members therein;

the conductor organizing sled having a cable termination end having a plurality of septa forming longitudinally extending channels for receiving and routing individual twisted pairs of conductors, said septa being channels to fit inside the jacket of said cable;

said sled further having a contact end having a plurality of grooves for holding and orienting the individual conductors of the conductor pairs in a substantially planar array; and at least one of said channels having a neck-down portion at an end thereof adjacent said grooves.

2. A plug as claimed in claim 1 and further comprising a crimping member dimensional to fit over the cable jacket and a wedge collar member dimensional to fit over said crimping member and insertable into said opening in said first end of said housing.

3. A plug as claimed in claim 2 wherein said wedge collar member has latching members thereon adapted to mate with latching means in said housing for affixing said wedge collar to said housing.

4. A plug as claimed in claim 1 and further including blade contact members insertable in said slots in said second end of said housing for making electrical contact with conductors in said grooves.

5. A plug as claimed in claim 1 wherein said septa are arranged in a cruciform configuration to form upper and lower and first and second side channels for accommodating four twisted pairs of conductors.

6. A plug as claimed in claim 5 wherein each of said first and second side channels has a neck-down portion at the end thereof adjacent said grooves.

7. A plug as claimed in claim 6 and further comprising a cover member having a planar top and depending sides adapted to straddle at least a portion of said sled along which the twisted pairs are routed.

8. A plug as claimed in claim 7 wherein said sled has slots on either side thereof for receiving said depending sides of said cover member, each of said slots having a bottom edge.

9. A plug as claimed in claim 8 wherein each of said depending sides has a distal end having a latching member thereon for latching to the bottom edges of said slots.

10. A plug as claimed in claim 1 wherein said housing and said conductor organizing sled are made of plastic.

11. For use in a terminating plug for a jacketed communication cable having a plurality of twisted pairs of conductors therein, a conductor organizing sled comprising:

an elongated member having a longitudinal axis having a substantially planar floor portion and first and second spaced side walls extending therefrom, said member having a cable termination end and a connector end;

a plurality of septa extending from said elongated member and forming a plurality of longitudinally extending channels for receiving and routing twisted pairs of conductors, the edges of said septa being dimensioned to fit inside of the jacket of the jacketed cable; and crimping means for crimping the jacket of the cable against the edges of the septa to affix the cable to said conductor organizing sled.

12. A conductor organizing sled as claimed in claim 11 wherein said floor portion has a plurality of conductor receiving grooves at said connector end of said elongated member.

13. A conductor organizing sled as claimed in claim 12 wherein said grooves are parallel to each other and form a planar array of grooves.

14. A conductor organizing sled as claimed in claim 12 wherein there are four septa forming a cruciform shaped structure which defines four longitudinally extending passages each of which is adapted to receive one twisted pair of conductors.

15. A conductor organizing sled as claimed in claim 14 wherein said four passages are arrayed as an upper passage, a lower passage, and first and second side passages, extending parallel to the longitudinal axis of said sled.

16. A conductor organizing sled as claimed in claim 15 wherein each of said side passages has a neck-down portion at an end thereof adjacent said grooves.

17. A conductor organizing sled as claimed in claim 16 wherein said floor portion has an opening therein for providing access to said grooves for the conductors of the twisted pair in said lower passage.

18. A conductor organizing sled as claimed in claim 11 and further comprising a cover member having a planar top and depending sides adapted to straddle at least a portion of said elongated member along which the twisted pairs are routed.

19. A conductor organizing sled as claimed in claim 18 and further including means for attaching said cover member to said elongated member.

* * * * *